US010767914B2

(12) United States Patent
Kuroda et al.

(10) Patent No.: US 10,767,914 B2
(45) Date of Patent: Sep. 8, 2020

(54) ICEMAKER AND FREEZER

(71) Applicant: NIDEC SERVO CORPORATION, Kiryu-shi, Gunma (JP)

(72) Inventors: Eiji Kuroda, Kiryu (JP); Kenji Sugaya, Kiryu (JP); Hironobu Yoshikawa, Kiryu (JP); Hideaki Ito, Kiryu (JP)

(73) Assignee: NIDEC SERVO CORPORATION, Gunma (JP)

( * ) Notice: Subject to any disclaimer, the term of this patent is extended or adjusted under 35 U.S.C. 154(b) by 89 days.

(21) Appl. No.: 16/307,535

(22) PCT Filed: Jun. 6, 2017

(86) PCT No.: PCT/JP2017/020989

§ 371 (c)(1),
(2) Date: Dec. 6, 2018

(87) PCT Pub. No.: WO2017/213141

PCT Pub. Date: Dec. 14, 2017

(65) Prior Publication Data

US 2019/0145685 A1 May 16, 2019

(30) Foreign Application Priority Data

Jun. 7, 2016 (JP) ..... 2016-113402

(51) Int. Cl.

| | |
|---|---|
| ***F25C 1/24*** | (2018.01) |
| ***F25D 27/00*** | (2006.01) |
| ***F25C 5/04*** | (2006.01) |
| ***F25C 5/20*** | (2018.01) |
| ***F25C 5/185*** | (2018.01) |

(52) U.S. Cl.
CPC ..... *F25C 1/24* (2013.01); *F25C 5/04* (2013.01); *F25C 5/185* (2013.01); *F25C 5/22* (2018.01); *F25D 27/00* (2013.01); *F25D 27/005* (2013.01); *F25C 2400/10* (2013.01)

(58) Field of Classification Search
CPC .... F25C 1/24; F25C 5/04; F25C 5/185; F25C 5/22; F25C 2400/10; F25D 27/00; F25D 27/005
See application file for complete search history.

(56) References Cited

U.S. PATENT DOCUMENTS

| | | | | |
|---|---|---|---|---|
| 2010/0170279 | A1 | 7/2010 | Aoki | |
| 2012/0297802 | A1 | 11/2012 | Tanaka et al. | |
| 2017/0314834 | A1* | 11/2017 | Park | F25C 5/187 |

FOREIGN PATENT DOCUMENTS

| | | | |
|---|---|---|---|
| JP | 56-114381 | U | 9/1981 |
| JP | 2009-281670 | A | 12/2009 |
| JP | 2009-299978 | A | 12/2009 |

OTHER PUBLICATIONS

Official Communication issued in International Patent Application No. PCT/JP2017/020989, dated Sep. 12, 2017.

* cited by examiner

*Primary Examiner* — Emmanuel E Duke
(74) *Attorney, Agent, or Firm* — Keating & Bennett, LLP

(57) ABSTRACT

An icemaker includes an ice-making tray in which ice is produced, an ice-discharging mechanism that removes the ice from the ice-making tray, a driver that drives the ice-discharging mechanism and that is attached to the ice-making tray on a front side in a front-rear direction, and a lighting unit that emits light. The lighting unit emits the light toward a rear side in the front-rear direction.

13 Claims, 4 Drawing Sheets

ICEMAKER AND FREEZER

BACKGROUND OF THE INVENTION

1. Field of the Invention

The present disclosure relates to an icemaker and a freezer.

2. Description of the Related Art

An automatic ice-making device installed in a freezer is known. For example, an automatic ice-making device that drops ice made with an ice-making tray into an ice storage tank by using an ice-discharging device is known.

As a freezer in which an automatic ice-making device such as that described above is installed, there is a freezer in which lighting is not installed. In the case of such a freezer, there are cases in which it is difficult for the user to view the interior of the freezer, resulting in a problem of reduced convenience for the user.

To solve this problem, it is conceivable to provide a lighting unit in the automatic ice-making device and illuminate the interior of the freezer with light emitted from the lighting unit. However, in the case of this configuration, depending on how the lighting unit is attached, the interior of the freezer may become too bright because the light emitted from the lighting unit may directly reach the eyes of the user, thus the convenience for the user may not be improved sufficiently in some cases.

SUMMARY OF THE INVENTION

An icemaker of an exemplary embodiment of the present disclosure is disposable in a freezer, and, when power is supplied, makes ice by using cold air of a freezing chamber to freeze water that has been poured into an ice-making tray and that discharges the ice, and includes an ice-making tray in which ice is produced, an ice-discharging mechanism that removes the ice from the ice-making tray, a driver that drives the ice-discharging mechanism and that is attached to the ice-making tray on a front side in a front-rear direction, and a lighting unit that emits light. The lighting unit emits the light toward a rear side in the front-rear direction.

A freezer of an exemplary embodiment of the present disclosure includes a freezer body that is box-shaped and that includes an opening on a front side in a front-rear direction, a door that opens and closes the opening, and an icemaker attached to a side surface on one side in a left-right direction perpendicular to both the front-rear direction and a top-bottom direction among inner side surfaces of the freezer body. The icemaker includes an ice-making tray in which ice is produced, an ice-discharging mechanism that removes the ice from the ice-making tray, a driver that drives the ice-discharging mechanism and that is attached to the ice-making tray on the front side, and a lighting unit that emits light. The lighting unit includes a light source and a circuit board to which the light source is attached, and emits the light toward a rear side in the front-rear direction. An attachment surface of the circuit board to which the light source is attached faces the rear side. When viewed in the top-bottom direction, an inclination of a first imaginary line with respect to the left-right direction, the first imaginary line connecting an end portion of the attachment surface on another side in the left-right direction and an end portion of the opening on the other side in the left-right direction, is equal to or less than an inclination of a second imaginary line with respect to the left-right direction, the second imaginary line connecting the light source and the end portion of the opening on the other side in the left-right direction.

The above and other elements, features, steps, characteristics and advantages of the present disclosure will become more apparent from the following detailed description of the preferred embodiments with reference to the attached drawings.

DETAILED DESCRIPTION OF THE PREFERRED EMBODIMENTS

In the following description, in the three-dimensional coordinate system illustrated in each drawing, the Z-axis direction is the vertical direction, and the X-axis direction and the Y-axis direction are perpendicular to the Z-axis direction and perpendicular to each other. In the Z-axis direction, the positive side is defined as "upper side" and the negative side is defined as "lower side". In addition, the X-axis direction is referred to as "front-rear direction", and the Y-axis direction is referred to as "left-right direction". In addition, in the X-axis direction, the positive side is defined as "front side" and the negative side is defined as "rear side". In addition, in the Y-axis direction, the positive side is defined as "right side" and the negative side is defined as "left side". Further, a top-bottom direction, the front-back direction, and the left-right direction are simply used for explanation, and do not limit actual positional relationships and directions.

Figure 1:
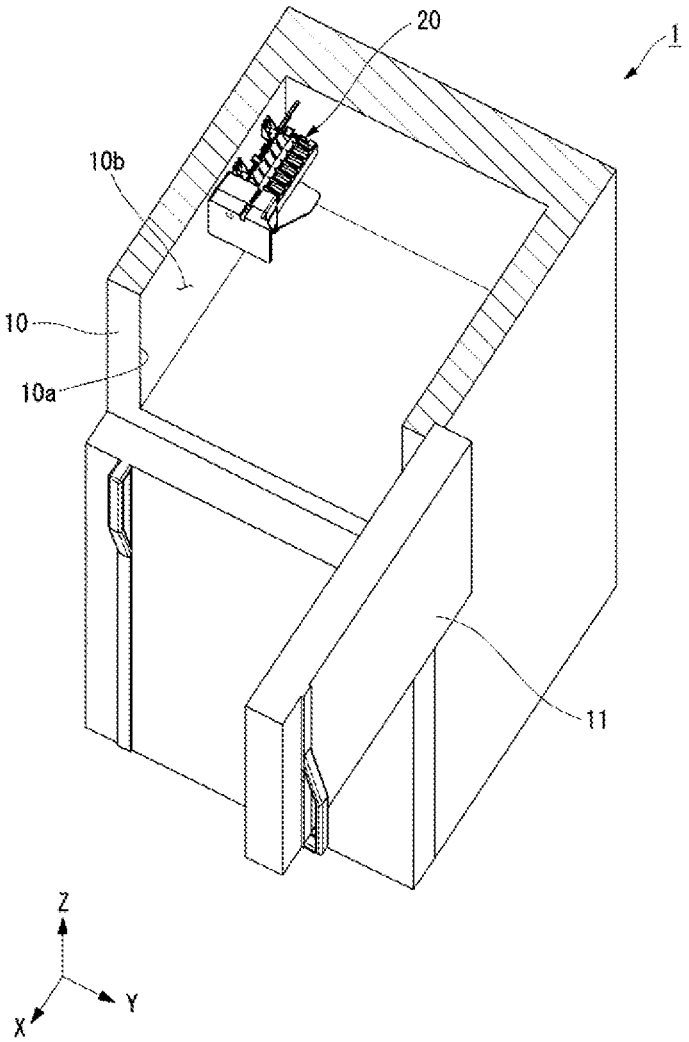
FIG. 1 is a perspective view illustrating a freezer according to a first exemplary embodiment of the present disclosure.

As illustrated in FIG. 1, a freezer 1 of the present embodiment includes a freezer body 10, a door 11, and an icemaker 20. The freezer body 10 has a box shape having an opening portion 10*a* on the front side in the front-rear direction. The opening portion 10*a* has a rectangular shape. Further, in FIG. 1, an upper end portion of the freezer body 10 is illustrated as a cross section perpendicular to the top-bottom direction.

Further, in this specification, "freezer" includes a freezer of a freezer refrigerator and a freezing chamber. That is, in the present specification, "freezer" includes, in addition to a dedicated freezer, a refrigerator with a freezer and a refrigerator with a freezing chamber.

The door 11 opens and closes the opening portion 10*a*. The door 11 is attached to the freezer body 10 on the right side of the opening portion 10*a*. The door 11 is attached to the freezer body 10 via, for example, a hinge, and is openable and closeable. Further, the door 11 may be attached to the freezer body 10 on the left side of the opening portion 10*a* or may be attached to the freezer body 10 on the upper side of the opening portion 10*a* or may be attached to the freezer body 10 on the lower side of the opening portion 10*a*.

The icemaker 20 is an icemaker that is disposable in the freezer 1, more specifically in the freezer body 10, and, when power is supplied, that makes ice by using cold air of the freezing chamber to freeze water which has been poured into an ice-making tray and that discharges the ice. Further, the freezing chamber is the inside of the freezer 1, that is, the inside of the freezer body 10. The icemaker 20 is attached to a side surface 10*b* on one side in the left-right direction perpendicular to both the front-rear direction and the top-bottom direction among the inner side surfaces of the freezer body 10. In FIG. 1, the side surface 10*b* is the side surface on the left side in the left-right direction among the inner side surfaces of the freezer body 10.

Figure 2:
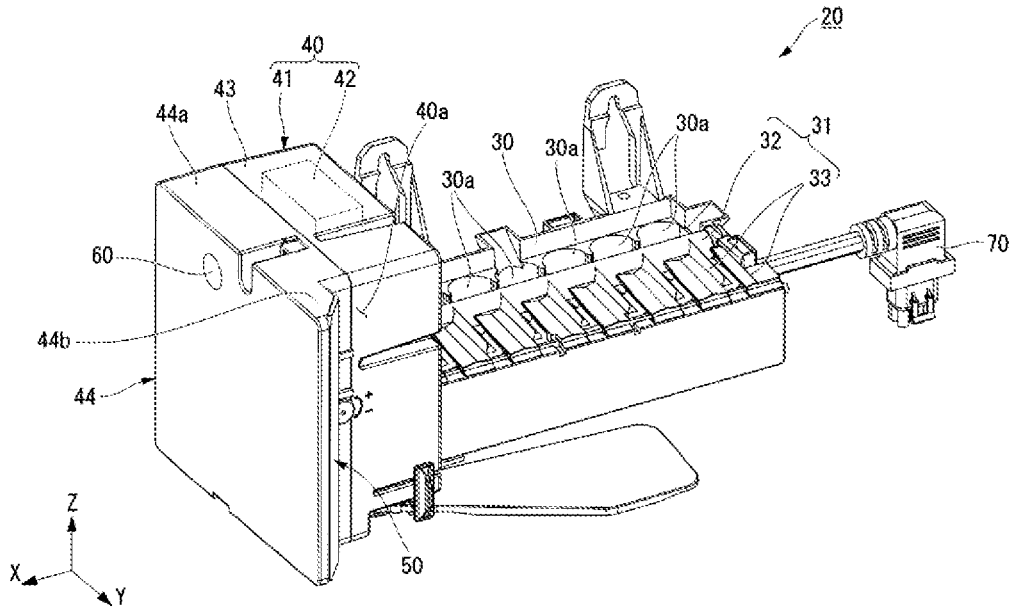
FIG. 2 is a perspective view illustrating an icemaker of the first exemplary embodiment of the present disclosure.

As illustrated in FIG. 2, the icemaker 20 includes an ice-making tray 30, an ice-discharging mechanism 31, a driver 40, a connector 70, a sensor 60, and a lighting unit 50. The ice-making tray 30 is a portion for manufacturing ice. The ice-making tray 30 has a substantially rectangular parallelepiped box shape that opens to the upper side and is elongated in the front-rear direction. The interior of the ice-making tray 30 is partitioned into a plurality of partition portions 30*a* along the front-rear direction. Water is supplied to each of the partition portions 30*a*. By freezing the water supplied to each of the partition portions 30*a*, ice is produced in each of the partition portions 30*a*. As a result, ice is produced in the ice-making tray 30.

Figure 3:
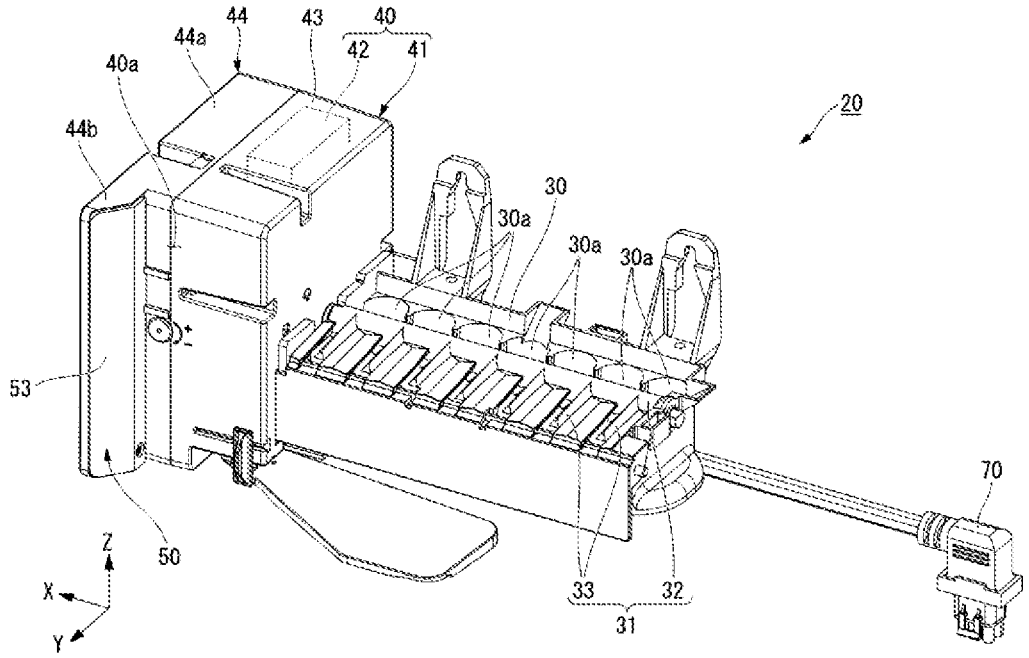
FIG. 3 is a perspective view illustrating the icemaker of the first exemplary embodiment of the present disclosure.

The ice-discharging mechanism 31 is a portion for taking out ice from the ice-making tray 30. The ice-discharging mechanism 31 includes an ice-discharging lever shaft 32 and a plurality of ice-discharging levers 33. The ice-discharging lever shaft 32 is a columnar shaft extending in the front-rear direction. An end portion of the ice-discharging lever shaft 32 on the rear side is connected to an upper end of a wall portion of the ice-making tray 30 on the rear side so as to be rotatable about the axis of the ice-discharging lever shaft 32. As illustrated in FIG. 3, an end portion of the ice-discharging lever shaft 32 on the front side is connected to the driver 40. The ice-discharging lever shaft 32 is rotated about the axis of the ice-discharging lever shaft 32 by the driver 40.

The ice-discharging levers 33 have a bar shape extending radially outward from the ice-discharging lever shaft 32. The plurality of ice-discharging levers 33 are disposed side by side along the front-rear direction. The ice-discharging levers 33 rotate about the axis of the ice-discharging lever shaft 32 when the ice-discharging lever shaft 32 rotates. When each of the ice-discharging levers 33 rotates, it passes through a corresponding one of the partition portions 30*a*.

The driver 40 is attached to a front side of the ice-making tray 30 in the front-rear direction. The driver 40 drives the ice-discharging mechanism 31. More specifically, the driver 40 rotates the ice-discharging lever shaft 32 about its axis. In the present embodiment, the driver 40 rotates the ice-discharging lever shaft 32 in the clockwise direction as viewed from the front side. The driver 40 includes a driver body 42 and a casing 41.

The driver body 42 rotates the ice-discharging lever shaft 32 about the axis of the ice-discharging lever shaft 32. The driver body 42 is an electric motor. The casing 41 houses the driver body 42. The casing 41 has a rectangular box shape. The casing 41 includes a main body 43 and a lid portion 44.

The main body 43 is box-shaped and opens to the front side. The driver body 42 is housed inside the main body 43. A wall portion of the ice-making tray 30 on the front side is fixed to a lower portion of a rear surface of the main body 43.

The lid portion 44 is attached to the front side of the main body 43. The lid portion 44 includes a lid portion body 44*a* and a lighting attachment portion 44*b*. The lid portion body 44*a* has a box shape that opens to the rear side. The lid portion body 44*a* covers the opening on the front side of the main body 43. The lid portion body 44*a* substantially overlaps the main body 43 as viewed in the front-rear direction.

The lighting attachment portion 44*b* projects rightward from the front end of a side surface on the right side of the lid portion body 44*a*. The lighting attachment portion 44*b* extends in the top-bottom direction from an upper end to a lower end of the lid portion body 44*a*. As illustrated in FIG. 2, a front surface of the lid portion body 44*a* and a front surface of the lighting attachment portion 44*b* constitute a front surface of the lid portion 44 perpendicular to the front-rear direction, that is, the front surface of the driver 40.

When the driver 40 drives the ice-discharging mechanism 31, the ice-discharging lever shaft 32 rotates, and each of the ice-discharging levers 33 passes through a corresponding one of the partition portions 30*a*. As a result, the ice produced in the partition portions 30*a* is pushed out from the partition portions 30*a* by each of the ice-discharging levers 33. The ice pushed out from the partition portions 30*a* is dropped and stored in an ice storage tank (not illustrated) disposed on the lower side of the icemaker 20. In this way, the ice produced in the ice-making tray 30 is removed by the driver 40 and the ice-discharging mechanism 31.

The connector 70 is led out from the driver 40 to the rear side of the ice-making tray 30 via a cable. The connector 70 is connected to an external power source that supplies power to the driver 40. The external power source to which the connector 70 is connected is the power source of the freezer 1.

The sensor 60 is a sensor for detecting the open/closed state of the freezer 1. That is, the sensor 60 detects the open/closed state of the door 11. The sensor 60 is disposed on the front surface of the driver 40. The sensor 60 is not particularly limited as long as it can detect the open/closed state of the freezer 1. In the present embodiment, the sensor 60 is an infrared sensor. Although not illustrated, the sensor 60 includes a cover. The material of the cover of the sensor 60 is, for example, high-density polyethylene, polypropylene or the like. Further, note that the sensor 60 may be a temperature sensor, a light detection sensor, or the like.

Figure 4:
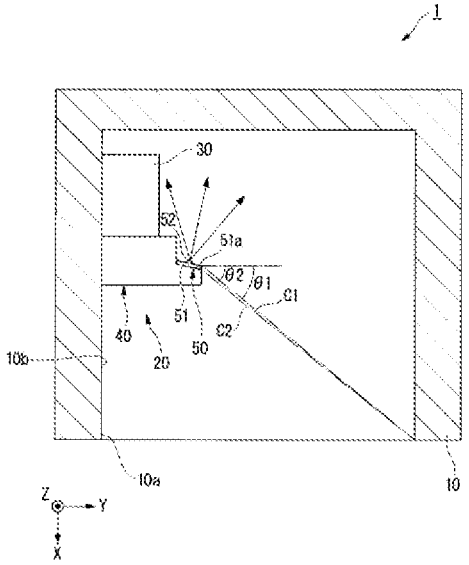
FIG. 4 is a plan view schematically illustrating a portion of the freezer of the first exemplary embodiment of the present disclosure.

The lighting unit 50 is a portion that emits light. As illustrated in FIG. 4, the lighting unit 50 emits light toward the rear side in the front-rear direction. Therefore, as in the freezer 1 of the present embodiment, when the icemaker 20 is disposed in a freezer with the driver 40 on the side of the opening portion 10*a* and the ice-making tray 30 of the icemaker 20 on the opposite side to the opening portion 10*a*, it is possible to suppress the light from the lighting unit 50 from directly going to the user. As a result, it is possible to illuminate the interior of the freezer 1 by the lighting unit 50 while suppressing excessive dazzling of the interior of the freezer 1. Therefore, the convenience for the user can be improved. Further, in the present specification, "the lighting unit emits light toward the rear side in the front-rear direction" means that the user or the like cannot at least directly observe the light emitted from the lighting unit from the outside of the freezer body via the opening portion or that the user or the like cannot at least directly observe the light emitted from the lighting unit when viewing the icemaker from the front side. That is, in the present specification, the phrase "the lighting unit emits light toward the rear side in the front-rear direction" includes, in addition to the case where light is emitted rearward from and normal to the lighting unit, the cases where light traveling in the left-right direction, in the top-bottom direction, and in a direction tilted toward both the left-right direction and the top-bottom direction with respect to a direction in which light travels rearward from and normal to the lightning unit is emitted from the lighting unit. Even in those cases, it is not possible to directly observe the light emitted from the lighting unit from the outside of the freezer body via the opening portion.

Further, it should be noted that "it is not possible to directly observe the light emitted from the lighting unit" includes the case where the light emitted from the lighting unit without being incident on other members does not enter the eyes of the user. That is, "it is not possible to directly observe the light emitted from the lighting unit" may include the case where light emitted from the lighting unit is reflected or refracted by other members and indirectly enters the eyes of the user even when the user cannot directly observe the light emitted from the lighting unit.

In addition, in the present specification, some of the light emitted from the lighting unit does not have to be light traveling toward the rear side in the front-rear direction. In the present specification, for example, it suffices that, among the light emitted from the lighting unit, the amount of light traveling toward the rear side in the front-back direction is larger than the amount of light not traveling toward the rear side in the front-rear direction. In addition, in this specification, for example, it suffices that the direction of the optical axis of the light emitted from the lighting unit is a direction that goes toward the rear side in the front-rear direction.

Further, in the following description, "toward the rear side in the front-rear direction" may be simply referred to as "rearward".

In the present embodiment, the direction of the light emitted from the lighting unit 50 is inclined with respect to the front-rear direction. Therefore, as compared with the case where the light emitted from the lighting unit 50 is emitted rearward from and normal to the lighting unit 50, the light emitted from the lighting unit 50 can be expanded in the left-right direction and the inside of the freezer 1 can be illuminated widely. As a result, it is possible to suitably brighten the interior of the freezer 1, and it is possible to further improve the convenience for the user. In the present embodiment, the optical axis of the light emitted from the lighting unit 50 is inclined diagonally rearward to the right side.

The lighting unit 50 is provided in the driver 40. Therefore, as in the freezer 1 of the present embodiment, when the icemaker 20 is placed in the freezer 1 with the driver 40 on the opening portion 10*a* side and the ice-making tray 30 of the icemaker 20 on the opposite side from the opening portion 10*a*, the lighting unit 50 can be disposed close to the opening portion 10*a*. Therefore, for example, compared with the case where the lighting unit 50 is provided on the ice-making tray 30, it is possible to lengthen the distance until the light emitted rearward from the lighting unit 50 reaches the rear-side wall in the freezer 1. As a result, the light emitted rearward from the lighting unit 50 easily spreads out in the freezer 1 and it is easy to illuminate the interior of the freezer 1 widely. Therefore, it is possible to make the interior of the freezer 1 suitably brighter, thereby further improving the convenience for the user. In addition, it is easy to receive power supply for the lighting unit 50 from the power supplied to the driver 40.

As illustrated in FIG. 3, the lighting unit 50 is provided on a side surface 40*a* of the driver 40 along the front-rear direction. Therefore, it is easy to adopt a configuration in which the lighting unit 50 emits light rearward. In addition, as in the freezer 1 of the present embodiment, when the icemaker 20 is attached to the side surface 10*b* in the freezer body 10, by emitting light from the lighting unit 50 diagonally rearward in the left-right direction, it is possible to widely illuminate the inside of the freezer 1 in the left-right direction. Therefore, the inside of the freezer 1 can be made more suitably brighter and the convenience for the user can be further improved.

In the present embodiment, the side surface 40*a* is the right side surface of the driver 40. More specifically, the side surface 40*a* is the right side surface of the casing 41. The lighting unit 50 is provided on the right side surface of the lid portion body 44*a* within the side surface 40*a*. In addition, as in the freezer 1 of the present embodiment, when the icemaker 20 is placed in the freezer with the driver 40 on the side of the opening portion 10*a* and the ice-making tray 30 of the icemaker 20 on the opposite side to the opening portion 10*a*, it is possible to dispose the lighting unit 50 closer to the opening portion 10*a*. Therefore, the inside of the freezer 1 can be made more suitably brighter and the convenience for the user can be further improved.

Figure 5:
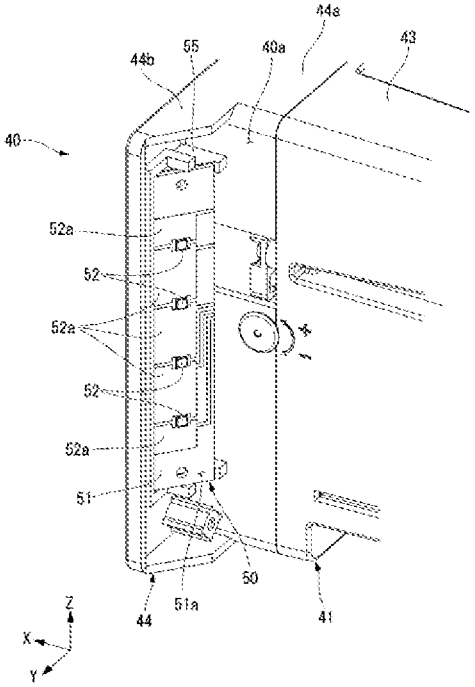
FIG. 5 is a perspective view illustrating a portion of the icemaker of the first exemplary embodiment of the present disclosure.

The lighting unit 50 is disposed on the rear side of the lighting attachment portion 44*b*. As illustrated in FIG. 5, the lighting unit 50 includes a board-fixing portion 55, a circuit board 51, and light sources 52. As illustrated in FIG. 3, the lighting unit 50 includes a cover 53. In FIG. 5, illustration of the cover 53 is omitted. As illustrated in FIG. 5, the board-fixing portion 55 is fixed to the rear surface of the lighting attachment portion 44*b* and the side surface 40*a*. The board-fixing portion 55 holds the circuit board 51.

The circuit board 51 has a rectangular plate shape that is elongated in the top-bottom direction. The circuit board 51 is fixed to the lid portion 44 by the board-fixing portion 55. The circuit board 51 is located on the rear side of the lighting attachment portion 44*b*. The entirety of the circuit board 51, as viewed along the front-rear direction, overlaps with the lighting attachment portion 44*b*.

The light sources 52 are attached to the circuit board 51. An attachment surface 51*a* to which the light sources 52 of the circuit board 51 are attached faces the rear side. Therefore, by attaching the light sources 52 to the attachment surface 51*a* of the circuit board 51, light can be emitted from the lighting unit 50 toward the rear side in the front-rear direction. In addition, even when the light from the light sources 52 leaks to the front side, light is blocked by the circuit board 51, and it is possible to further suppress the light from the lighting unit 50 from directly going to the user. As a result, this can further suppress the interior of the freezer 1 from becoming dazzling.

Further, in the present specification, the phrase "the attachment surface faces the rear side" means that, as viewed from the rear side, at least a portion of the attachment surface can be observed. In the present embodiment, the attachment surface 51*a* is inclined with respect to a plane perpendicular to the front-rear direction. Therefore, by attaching the light sources 52 to the attachment surface 51*a* of the circuit board 51, light can be emitted from the lighting unit 50 rearward inclined with respect to the front-back direction. In the present embodiment, the attachment surface 51*a* faces diagonally rearward toward the right side.

The light sources 52 are light emitting diodes. A plurality of the light sources 52 are provided. In FIG. 5, four light sources 52 are provided. The plurality of the light sources are disposed at intervals in the top-bottom direction perpendicular to the front-back direction. For example, when a plurality of light sources are disposed in one location, light rays from the plurality of light sources are collectively emitted from the one location, and the location where the plurality of light sources are collectively disposed is locally bright. Therefore, the user may feel that the light emitted from the lighting unit is dazzling. In addition, when a plurality of light sources are collectively disposed in one location, the calorific value of the light sources locally increases and the light sources reach a high temperature in some cases. In the case where the light sources are light emitting diodes, the amount of luminescence decreases due to the high temperature and a sufficient amount of light may not be obtained in some cases.

On the other hand, according to the present embodiment, by disposing the plurality of the light sources 52 at intervals in the top-bottom direction, it is possible to disperse the light emitted from the lighting unit 50 in the top-bottom direction. Therefore, it is possible to suppress local brightening of a portion of the lighting unit 50 and to suppress the user from being dazzled.

In addition, when the plurality of the light sources 52 are disposed at intervals, it is possible to provide lands, solid wires, and the like for the light sources 52 between the respective light sources 52 on the circuit board 51. As a result, for example, by using copper foil as the material for the lands, solid wires, and the like, the heat dissipation property of the light sources 52 can be improved. Therefore, it is possible to suppress a high temperature of the light sources 52 and to suppress a decrease in the amount of light of the light sources 52. In the present embodiment, solid wires 52*a* composed of copper foil are provided between the light sources 52 on the attachment surface 51*a* of the circuit board 51 and on the upper side of the light source 52 at the uppermost side and on the lower side of the light source 52 at the lowermost side.

In addition, in the present embodiment, as compared with the case where the plurality of the light sources 52 are disposed at intervals in the left-right direction, because the plurality of the light sources 52 are disposed at intervals in the top-bottom direction, it is possible to suppress the icemaker 20 from becoming large in the left-right direction. In addition, as compared with the case where the plurality of the light sources 52 are disposed at intervals in the front-rear direction, the positions of the light sources 52 can be easily brought close to the opening portion 10*a* and the interior of the freezer 1 can be suitably illuminated brightly.

As illustrated in FIG. 3, the cover 53 is fixed to the rear side of the lighting attachment portion 44*b*. The cover 53 is a plate-like member extending in the top-bottom direction. The cover 53 covers the board-fixing portion 55, the circuit board 51, and the light sources 52 from the rear side. The cover 53 has a property of transmitting the light emitted from the light sources 52. In the present embodiment, the light emitted from the lighting unit 50 is light emitted from the cover 53 toward the outside of the icemaker 20. That is, in the present embodiment, the light emitted from the cover 53 is emitted rearward.

In the present embodiment, the arrangement relationship between the lighting unit 50 and the opening portion 10*a* is a predetermined arrangement relationship. As illustrated in FIG. 4, as viewed in the top-bottom direction, an imaginary line connecting a right end portion of the attachment surface 51*a* and a right end portion of the opening portion 10*a* is defined as a first imaginary line C1. An imaginary line connecting the light source 52 and the right end portion of the opening portion 10*a* is defined as a second imaginary line C2.

Further, note that the right end portion of the attachment surface 51*a* is the end portion of the attachment surface 51*a* on the opposite side to the side surface 10*b* to which the icemaker 20 is attached and corresponds to the end portion of the attachment surface 51*a* on another side in the left-right direction. The right end portion of the opening portion 10*a* is the end portion of the opening portion 10*a* on the opposite side to the side surface 10*b* to which the icemaker 20 is attached and corresponds to the end portion of the opening portion 10*a* on the other side in the left-right direction.

The inclination θ1 of the first imaginary line C1 with respect to the left-right direction is equal to or less than the inclination θ2 of the second imaginary line C2 with respect to the left-right direction. When this relationship is satisfied, the user cannot observe the light sources 52 from the outside of the freezer body 10 via the opening portion 10*a*. Therefore, it is possible to inhibit the light of the light sources 52 from directly entering the eyes of the user and to suppress the user from being dazzled. In FIG. 4, the inclination θ1 of the first imaginary line C1 with respect to the left-right direction is smaller than the inclination θ2 of the second imaginary line C2 with respect to the left-right direction.

The lighting unit 50 emits light when the sensor 60 detects that the freezer 1 is in an open state. Therefore, it is possible to suitably control the emission of light by the lighting unit 50 as necessary when the user observes the interior of the freezer 1 or the like. As a result, it is possible to save electric power required for the lighting unit 50. In the present embodiment, the sensor 60 detects that the freezer 1 is in an open state when movement of a person is detected.

In the present embodiment, the lighting unit 50, for example, emits light after the sensor 60 has detected that the freezer 1 has been in an open state for a predetermined time. In the case where the sensor 60 is an infrared sensor, there is a case where the sensor 60 reacts to an induced electromotive force generated from the driver 40 and the freezer 1 is erroneously detected as being in an open state. Here, the time during which the induced electromotive force occurs is a short time. Therefore, by adopting a configuration in which the lighting unit 50 emits light when it is detected that the freezer 1 has been continuously in an open state for a predetermined time longer than the time over which the induced electromotive force is generated, erroneous detection of the state of the freezer 1 can be suppressed.

The present disclosure is not limited to the embodiment described above and other configurations may be adopted. In the following explanation, the same reference numerals are given for the same configurations as those described above so that explanation may be omitted in some cases.

The arrangement location of the lighting unit 50 is not particularly limited as long as light can be emitted rearward from the lighting unit 50. The lighting unit 50 may be provided on the lower surface of the lid portion 44 or may be provided on the upper surface of the lid portion 44. In addition, the lighting unit 50 may be provided on the main body 43 of the casing 41 or may be provided on the ice-making tray 30.

In addition, the number of the light sources 52 may be one or more, three or less, or five or more. The directions in which light is emitted from the plurality of the light sources 52 may be different from each other. The plurality of the light sources 52 may be disposed in one location.

In addition, the type of the light sources 52 is not particularly limited and the light sources 52 may be light sources other than light emitting diodes. The light sources 52 may be, for example, laser light sources, lamp light sources, or the like. Depending on the type of the light sources 52, the circuit board 51 need not be provided.

Figure 6:
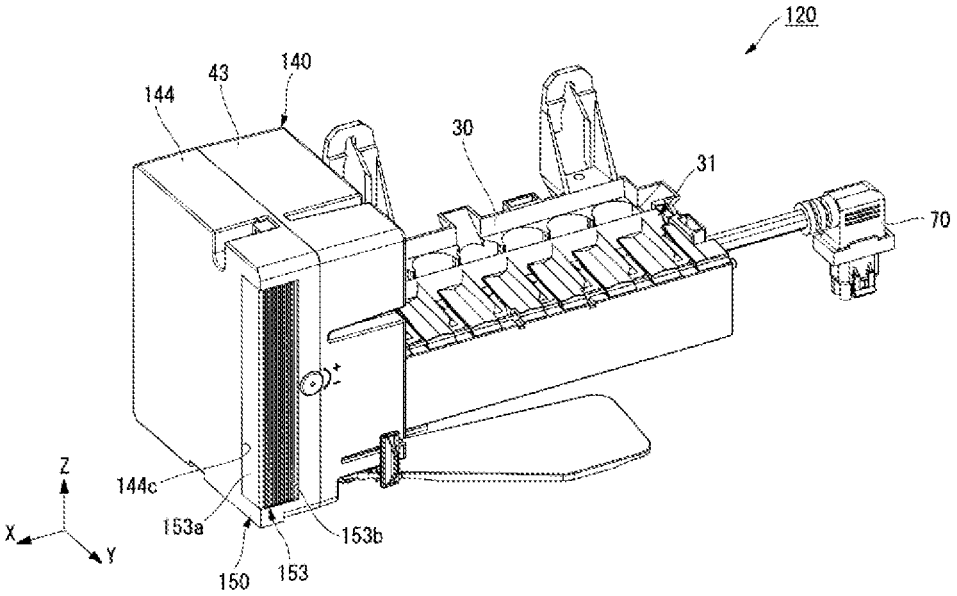
FIG. 6 is a perspective view illustrating an icemaker of a second exemplary embodiment of the present disclosure.

As illustrated in FIG. 6, in an icemaker 120 of the present embodiment, a lid portion 144 of a driver 140 is different from the lid portion 44 of the first embodiment in that the lid portion 144 does not include the lighting attachment portion 44*b*. The lid portion 144 has a lighting attachment recessed portion 144*c* recessed toward the left side from the right side surface of the lid portion 144. The lighting attachment recessed portion 144*c*, as viewed from the right side, has a rectangular shape elongated in the top-bottom direction. The lighting attachment recessed portion 144*c* is provided at the front end of the right side surface of the lid portion 144 and opens to the front side.

Figure 7:
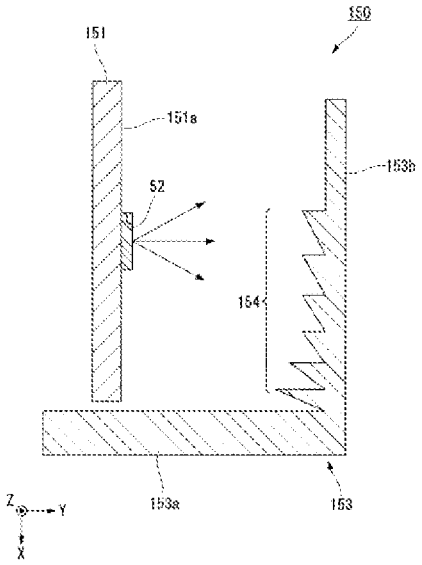
FIG. 7 is a plan view illustrating a lighting unit according to the second exemplary embodiment of the present disclosure.

A lighting unit 150 is disposed in the lighting attachment recessed portion 144*c*. As illustrated in FIG. 7, a circuit board 151 is disposed perpendicular to the left-right direction. That is, in the circuit board 151, an attachment surface 151*a* to which the light sources 52 are attached is disposed along the front-rear direction. Therefore, the proportion of the circuit board 151 in the left-right direction to the lighting unit 150 can be reduced. Light is emitted from the light sources 52 attached to the attachment surface 151*a* toward the right side.

The lighting unit 150 includes an optical member 153 on which light emitted from the light sources 52 is incident. The optical member 153 has a property of transmitting the light emitted from the light sources 52. The optical member 153 includes a front cover portion 153*a*, a right cover portion 153*b*, and a light-refracting portion 154.

The front cover portion 153*a* has a plate shape that extends along a plane perpendicular to the front-rear direction. As illustrated in FIG. 6, the shape of the front cover portion 153*a* seen from the front side is a rectangular shape elongated in the top-bottom direction. A front surface of the front cover portion 153*a* is disposed on substantially the same plane as a front surface of the lid portion 144.

The right cover portion 153*b* is in the form of a plate extending from a right end portion of the front cover portion 153*a* toward the rear side. The shape of the right cover portion 153*b* seen from the right side is a rectangular shape elongated in the top-bottom direction. A right surface of the right cover portion 153*b* is disposed on substantially the same plane as a right surface of the lid portion 144.

As illustrated in FIG. 7, the light-refracting portion 154 is provided on a left surface of the right cover portion 153*b*. The light-refracting portion 154 is constituted by a plurality of projecting portions that protrude leftward from the right cover portion 153*b* and that are disposed along the front-rear direction. Each projecting portion extends in the top-bottom direction. The light-refracting portion 154 is a portion of a Fresnel lens. That is, the optical member 153 includes at least a portion of a Fresnel lens. More specifically, in the present embodiment, the light-refracting portion 154 is a portion of a linear Fresnel lens.

The light emitted from the light sources 52 is incident on the optical member 153. More specifically, the light emitted from the light sources 52 is incident on the light-refracting portion 154. The light incident on the light-refracting portion 154 is refracted or reflected and is emitted rearward. As a result, the optical member 153 emits the incident light rearward in the front-rear direction.

As described above, according to the present embodiment, the direction of the light emitted from the light sources 52 can be changed rearward by the optical member 153. Therefore, the degree of freedom of arrangement of the circuit board 151 and the light sources 52 can be improved. In addition, because the optical member 153 includes at least a portion of a Fresnel lens, the light incident on the Fresnel lens can be suitably emitted rearward.

Further, the configuration of the optical member 153 is not particularly limited as long as light incident from the light sources 52 can be emitted rearward. The light-refracting portion 154 is not particularly limited as long as it can refract and emit the light rearward, and the light-refracting portion 154 need not be a portion of the Fresnel lens. Instead of the light-refracting portion 154, the optical member 153 may have a light-reflecting portion that reflects the incident light rearward. The optical member 153 may be constituted only by the light-refracting portion 154 or may be constituted only by the light-reflecting portion.

While preferred embodiments of the present disclosure have been described above, it is to be understood that variations and modifications will be apparent to those skilled in the art without departing from the scope and spirit of the present disclosure. The scope of the present disclosure, therefore, is to be determined solely by the following claims.

The invention claimed is:

1. An icemaker that is disposable in a freezer, and, when power is supplied, that makes ice by using cold air of a freezing chamber to freeze water that has been poured into an ice-making tray and that discharges the ice, the icemaker comprising: an ice-making tray in which ice is produced; an ice-discharging mechanism that removes the ice from the ice-making tray; a driver that drives the ice-discharging mechanism and that is attached to the ice-making tray on a front side in a front-rear direction of the freezes; and a lighting unit that emits light; wherein the lighting unit emits the light toward a rear side in the front-rear direction.

2. The icemaker according to claim 1, wherein a direction in which the light is emitted from the lighting unit is inclined with respect to the front-rear direction.

3. The icemaker according to claim 1, wherein the lighting unit includes at least one light source and a circuit board to which the at least one light source is attached, and an attachment surface of the circuit board to which the at least one light source is attached faces the rear side.

4. The icemaker according to claim 3, wherein the attachment surface is inclined with respect to a plane perpendicular to the front-rear direction.

5. The icemaker according to claim 3, wherein the at least one light source includes a plurality of light sources;

the plurality of light sources are disposed at intervals in a top-bottom direction perpendicular to the front-rear direction; and the at least one light source is a light emitting diode.

6. The icemaker according to claim 1, wherein the lighting unit includes at least one light source and an optical member on which light emitted from the at least one light source is incident; and the optical member emits the incident light in a direction toward the rear side in the front-rear direction.

7. The icemaker according to claim 6, wherein the optical member includes at least a portion of a Fresnel lens.

8. The icemaker according to claim 6, wherein the lighting unit further includes a circuit board to which the at least one light source is attached; and an attachment surface of the circuit board to which the at least one light source is attached is disposed along the front-rear direction.

9. The icemaker according to claim 1, wherein the lighting unit is provided in the driver.

10. The icemaker according to claim 1, wherein the lighting unit is provided on a side surface of the driver along the front-rear direction.

11. The icemaker according to claim 1 further comprising:

a sensor that detects an open/closed state of the freezer; wherein the lighting unit emits light when the sensor detects that the freezer is in an open state.

12. A freezer comprising the icemaker according to claim 1.

13. A freezer comprising:

a freezer body that is box-shaped and that includes an opening on a front side in a front-rear direction;

a door that opens and closes the opening; and an icemaker attached to a side surface on one side in a left-right direction perpendicular to both the front-rear direction and a top-bottom direction among inner side surfaces of the freezer body; wherein the icemaker includes an ice-making tray in which ice is produced, an ice-discharging mechanism that removes the ice from the ice-making tray, a driver that drives the ice-discharging mechanism and that is attached to the ice-making tray on the front side, and a lighting unit that emits light; wherein the lighting unit includes a light source and a circuit board to which the light source is attached, and emits the light toward a rear side in the front-rear direction;

an attachment surface of the circuit board to which the light source is attached faces the rear side; and when viewed in the top-bottom direction, an inclination of a first imaginary line with respect to the left-right direction, the first imaginary line connecting an end portion of the attachment surface on a first side in the left-right direction and an end portion of the opening on a second side in the left-right direction, is equal to or less than an inclination of a second imaginary line with respect to the left-right direction, the second imaginary line connecting the light source and the end portion of the opening on the second side in the left-right direction.

* * * * *